US010562168B2

(12) United States Patent
Lutz et al.

(10) Patent No.: US 10,562,168 B2
(45) Date of Patent: Feb. 18, 2020

(54) HANDHELD POWER TOOL

(71) Applicant: Robert Bosch GmbH, Stuttgart (DE)

(72) Inventors: Manfred Lutz, Filderstadt (DE); Florian Esenwein, Leinfelden-Echterdingen (DE); Joern Stock, Bempflingen (DE); Joerg Maute, Sindelfingen (DE); Joachim Schadow, Stuttgart (DE); Daniel Barth, Leinfelden-Echterdingen (DE); Cornelius Boeck, Kirchheim (DE)

(73) Assignee: Robert Bosch GmbH, Stuttgart (DE)

( * ) Notice: Subject to any disclaimer, the term of this patent is extended or adjusted under 35 U.S.C. 154(b) by 674 days.

(21) Appl. No.: 14/606,762

(22) Filed: Jan. 27, 2015

(65) Prior Publication Data

US 2015/0209950 A1 Jul. 30, 2015

(30) Foreign Application Priority Data

Jan. 27, 2014 (DE) ..... 10 2014 201 435

(51) Int. Cl.
*B25F 5/02* (2006.01)
*B24B 23/02* (2006.01)

(52) U.S. Cl.
CPC ..... *B25F 5/02* (2013.01); *B24B 23/028* (2013.01)

(58) Field of Classification Search
CPC ..... B25F 5/02; B25F 5/021; B24B 23/028
USPC ..... 173/20
See application file for complete search history.

(56) References Cited

U.S. PATENT DOCUMENTS

| | | | | |
|---|---|---|---|---|
| 7,182,148 | B1 * | 2/2007 | Szieff | B25B 21/00 173/171 |
| 2005/0121209 | A1 * | 6/2005 | Shimizu | B25B 21/00 173/217 |
| 2005/0261870 | A1 | 11/2005 | Cramer et al. | |
| 2006/0220612 | A1 * | 10/2006 | Feldmann | B25F 5/02 320/114 |
| 2009/0229842 | A1 * | 9/2009 | Gray | H01M 2/1055 173/20 |
| 2011/0314683 | A1 * | 12/2011 | Koeder | B23D 59/002 30/393 |

FOREIGN PATENT DOCUMENTS

| | | | | |
|---|---|---|---|---|
| DE | 29 33 355 | A1 | 3/1981 | |
| DE | 43 18 980 | A1 | 12/1994 | |
| DE | 4318980 | A1 * | 12/1994 | G08B 5/38 |
| DE | 102 56 804 | A1 | 6/2004 | |

(Continued)

*Primary Examiner* — Robert F Long
*Assistant Examiner* — Xavier A Madison
(74) *Attorney, Agent, or Firm* — Maginot, Moore & Beck LLP

(57) ABSTRACT

A handheld power tool includes at least one housing unit, at least one tool receptacle, at least one operating unit that has at least one operating element, and at least one electrical and/or electronic indication unit. The indication unit has at least one at least partially circumferentially arranged indication element that is configured to indicate at least one handheld power tool characteristic variable. The indication element in one embodiment is arranged on the housing unit in a region between the operating element the tool receptacle The indication element in another embodiment is arranged at least substantially adjacent to the operating element.

18 Claims, 7 Drawing Sheets

(56) References Cited

FOREIGN PATENT DOCUMENTS

| | | | | |
|---|---|---|---|---|
| DE | 10 2006 005 410 | A1 | 8/2007 | |
| DE | 10 2009 035 134 | A1 | 2/2011 | |
| DE | 102010040122 | A1 * | 3/2012 | ..... B25F 5/021 |
| DE | 20 2012 010 039 | U1 | 11/2012 | |
| DE | 10 2011 089 343 | A1 | 6/2013 | |
| GB | 2 426 225 | A | 11/2006 | |
| WO | 2006/020571 | A2 | 2/2006 | |

* cited by examiner

FIG. 2
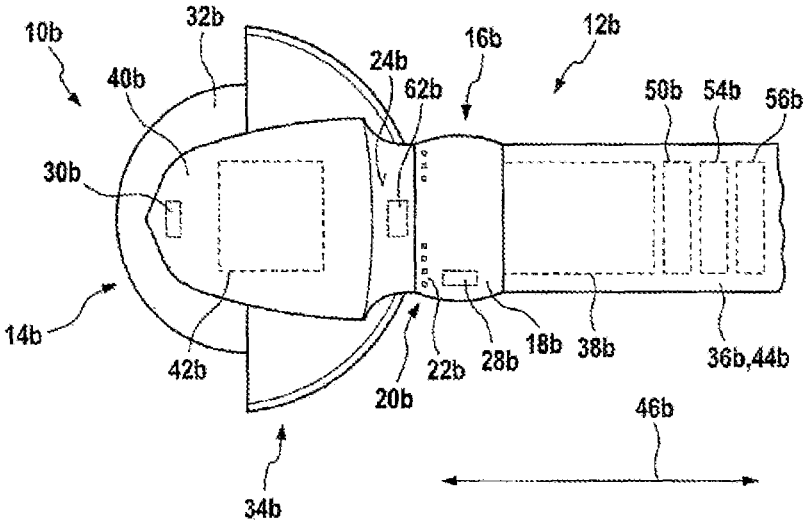
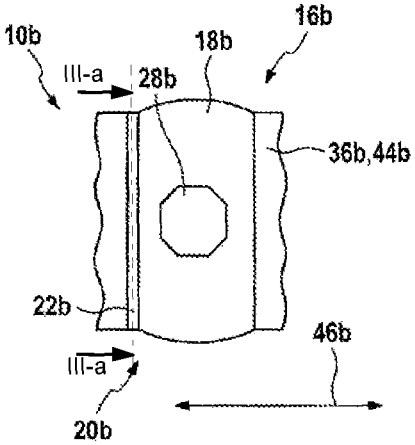
FIG. 3
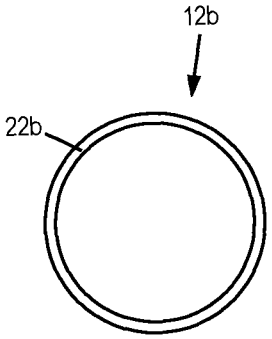
FIG. 3a

HANDHELD POWER TOOL

This application claims priority under 35 U.S.C. § 119 to patent application no. DE 10 2014 201 435.2, filed on Jan. 27, 2014 in Germany, the disclosure of which is incorporated herein by reference in its entirety.

BACKGROUND

DE 43 18 980 A1 has already disclosed a handheld power tool which comprises a housing unit, a tool receptacle, an operating unit which comprises an operating element, and an electrical and/or electronic indication unit which has a circumferentially arranged indication element for indicating a handheld power tool characteristic variable.

SUMMARY

The disclosure is based on a handheld power tool having at least one housing unit, having at least one tool receptacle, having at least one operating unit which has at least one operating element, and having at least one electrical and/or electronic indication unit which has at least one at least partially circumferentially arranged indication element for indicating at least one handheld power tool characteristic variable.

It is proposed that at least the indication element be arranged on the housing unit in a region between the operating element and the tool receptacle, and/or be arranged at least substantially adjacent to the operating element. Here, a "handheld power tool" should be understood in particular to mean a power tool for machining workpieces, which power tool can be transported by an operator without the use of a transportation machine and, in particular, can be held by an operator using at least one hand during the machining of a workpiece. The handheld power tool has in particular a mass of less than 40 kg, preferably less than 10 kg and particularly preferably less than 5 kg. In a preferred refinement, the handheld power tool is designed as an angle grinder. It is however also conceivable for the handheld power tool to be of some other configuration that would appear expedient to a person skilled in the art, for example a configuration as a power drill, a jigsaw, a saber saw, a hammer drill and/or a chipping hammer, a battery-powered screwdriver, a planing machine, a grinding machine or the like.

The housing unit of the handheld power tool preferably has a gearing housing and a motor housing. The gearing housing is preferably at least partially formed from a metallic material. The motor housing is preferably at least partially formed from a plastic. In an alternative embodiment of the handheld power tool, however, it is also conceivable for the housing unit to have a combination housing which is provided for accommodating and/or mounting a drive unit and/or an output unit of the handheld power tool. "Provided" should be understood in particular to mean specially designed and/or specially equipped. The statement that an element and/or a unit are/is provided for a particular function should be understood in particular to mean that the element and/or the unit performs(s) and/or execute(s) said particular function in at least one usage and/or operating state. The housing unit may have a shell type of construction or pot type of construction or may have a combination of a shell type of construction and a pot type of construction.

The expression "tool receptacle" should be understood in particular to mean an element or a unit of the handheld power tool to which a machining tool can be detachably fastened in order to be driven by means of at least one drive unit of the handheld power tool. The tool receptacle is preferably provided for rotationally conjointly receiving the machining tool. Thus, the tool receptacle preferably comprises at least one rotary driving element. The rotary driving element is preferably provided for a transmission of torque to the machining tool. In this case, the rotary driving element is preferably connectable to the machining tool in positively locking and/or non-positively locking fashion. The rotary driving element is preferably connected rotationally conjointly to an output spindle of the handheld power tool. It is however also conceivable for the tool receptacle to be fixedly connectable to the machining tool for a translational transmission of force, in particular for a translational transmission of drive force.

Here, an "operating unit" should be understood in particular to mean a unit which has at least one component which is directly actuable by an operator and which is provided for influencing and/or modifying a process and/or a state of a unit, which is coupled to the operating unit, by way of an actuation and/or an input of parameters. The operating unit is preferably provided at least for energizing and/or interrupting a supply of power to the drive unit of the handheld power tool. The operating element is preferably in the form of a switch-actuating element which actuates an electrical switch for the purpose of energizing and/or interrupting a supply of power to the drive unit of the handheld power tool. In this case, the operating element may be mounted so as to be movable in pivotable, rotatable and/or translational fashion. Furthermore, it is preferably the case that characteristic variables of the handheld power tool can be adjusted and/or varied by means of the operating unit. It is conceivable here for a rotational speed of the drive unit, a torque of the drive unit, a starting torque etc. to be adjustable and/or variable by means of the operating unit.

An "electrical and/or electronic indication unit" should be understood in particular to mean a unit by means of which a visually variable signal can be output and/or which, in at least one indication state, outputs at least one signal that is visible to a person. The indication element itself may in this case be formed as a luminous element cover, for example as a light conductor, as a reflector, as a luminous element, for example an individual LED, as a printed circuit board with multiple LEDs, and/or as a backlit indication unit, in particular as a matrix indication unit, for example as an LCD display, an OLED display and/or as electronic paper (E-paper, E-Ink). The handheld power tool may furthermore comprise, in addition to the indication unit, at least one acoustic and/or haptic output unit for outputting information to an operator.

Here, the expression "at least partially circumferentially arranged" should be understood in particular to mean an arrangement of at least one element and/or of a unit relative to a further element and/or a further unit, wherein a maximum extent of the element and/or of the unit along a circumferential direction corresponds to at least 5% of a maximum circumferential extent of the further element and/or of the further unit. Thus, the indication element, viewed along the circumferential direction, preferably has a maximum extent which is in particular greater than 5% of a maximum circumferential extent of the housing unit, preferably greater than 8% of the maximum circumferential extent of the housing unit and particularly preferably greater than 15% of the maximum circumferential extent of the housing unit. The circumferential extent runs preferably in a plane extending at least substantially perpendicular to a main direction of extent of the handheld power tool and/or at least substantially perpendicular to an axis of rotation of the drive unit of the handheld power tool. Here, the expression "substantially perpendicular" is intended in particular to define an orientation of a direction relative to a reference direction, wherein the direction and the reference direction, viewed in particular in a plane, enclose an angle of 90°, and the angle has a maximum deviation of in particular less than 8°, advantageously less than 5° and particularly advantageously less than 2°.

It is particularly preferably the case that the indication element, viewed along a main direction of extent of the handheld power tool, is arranged on the housing unit in a region between the operating element and the tool receptacle. It is particularly preferably the case that the main direction of extent of the handheld power tool runs at least substantially parallel to the axis of rotation of the drive unit of the handheld power tool and/or to a movement axis of an output unit of the handheld power tool. Here, "substantially parallel" should be understood in particular to mean an orientation of a direction relative to a reference direction, in particular in a plane, wherein the direction has a deviation of in particular less than 8°, advantageously less than 5° and particularly advantageously less than 2° relative to the reference direction.

Here, the expression "at least substantially adjacent" is intended in particular to define an arrangement of at least one element and/or one unit relative to a further element and/or a further unit, wherein a minimum spacing between the element and/or the unit and the further element and/or the further unit is in particular less than 20 mm, preferably less than 10 mm and particularly preferably less than 5 mm. The indication element is preferably arranged directly adjacent to the operating element. Here, the indication element preferably has a minimal spacing of less than 3 mm to the operating element.

By means of the configuration of the handheld power tool according to the disclosure, advantageous outputting of information to an operator can be made possible. An operator of the handheld power tool can thus be advantageously provided with information regarding a wide variety of characteristic variables of the handheld power tool and/or states of the handheld power tool. Furthermore, it is possible to achieve that the indication unit, in particular the indication element, can be read off in an advantageous manner. Furthermore, it is advantageously possible to prevent situations in which the indication unit, in particular the indication element, is concealed by a hand of an operator during operation of the handheld power tool. It can thus advantageously be made possible for the indication unit, in particular the indication element, to be reliably read off by the operator from a wide variety of viewing angles. Furthermore, the indication element can advantageously be used as an operator guide, in order to achieve that the handheld power tool can be operated in a self-explanatory manner.

It is furthermore proposed that the indication element be arranged on the housing unit close to an output. Here, the expression "arranged close to an output" should be understood in particular to mean an arrangement of at least one element and/or one unit relative to an output unit of the handheld power tool, in particular relative to an output movement axis of the output unit, wherein a minimum spacing between the element and/or the unit and the output unit, in particular to the output movement axis, is in particular less than 100 mm, preferably less than 50 mm and particularly preferably less than 30 mm Thus, the indication element preferably has a minimal spacing to the output unit, in particular to the output movement axis, of in particular less than 100 mm, preferably less than 50 mm and particularly preferably less than 30 mm Here, the indication element is particularly preferably arranged on the gearing housing of the housing unit. By means of the design according to the disclosure, an arrangement of the indication unit, in particular of the indication element, can advantageously be made possible in a region of the housing unit which is easily visible to an operator during the machining of a workpiece by means of the handheld power tool. It is thus advantageously possible for an operator to be conveniently provided with information regarding a wide variety of states of the handheld power tool during the machining of a workpiece.

It is furthermore proposed that the indication element extend around the housing unit over at least 25% of a maximum overall circumferential extent of the housing unit. Thus, the indication element preferably has a maximum extent along the circumferential direction which corresponds to at least 25% of the maximum overall circumferential extent of the housing unit. In particular, the indication element extends around the housing unit at least over 30% of the maximum overall circumferential extent of the housing unit, preferably at least over 50% of the maximum overall circumferential extent of the housing unit and particularly preferably at least over 70% of the maximum overall circumferential extent of the housing unit. In a particularly preferred embodiment of the handheld power tool, the indication element extends all the way around the housing unit. By means of the embodiment according to the disclosure, it can advantageously be made possible for the indication element to be viewed from different viewing angles.

It is furthermore proposed that the indication element terminate at least substantially flush with an outer surface of the housing unit. Here, "terminate at least substantially flush" should be understood in particular to mean an arrangement of the indication element on the housing unit wherein the indication element extends in particular less than 10 mm, preferably less than 5 mm and particularly preferably less than 2 mm over the outer surface, in particular viewed along a direction running from an inner surface of the housing unit in the direction of the outer surface of the housing unit. The indication element is particularly preferably arranged in a receiving recess of the housing unit, and extends at a maximum to the outer surface of the housing unit, in particular viewed along a direction running from an inner surface of the housing unit in the direction of the outer surface of the housing unit. It is thus advantageously possible to realize a compact arrangement of the indication element. Furthermore, the indication element can be protected against damage in an advantageous manner.

It is furthermore proposed that the indication unit have at least one further indication element which has a main extent running at least substantially perpendicular to a main extent of the indication element. Here, "substantially perpendicular" should be understood in particular to mean an orientation of a direction and/or of an axis relative to a reference direction and/or a reference axis, wherein the orientation of the direction and/or of the axis is at least different from an at least substantially parallel orientation relative to the reference direction and/or to the reference axis, and is in particular oblique or perpendicular relative to the reference direction and/or the reference axis. The indication element particularly preferably has a longitudinal axis which extends at least substantially parallel to the axis of rotation of the drive unit and/or to the output movement axis of the output unit. Thus, the further indication element preferably extends at least substantially perpendicular to the circumferential direction. The further indication element preferably has a maximum extent along the longitudinal axis. The further indication element is preferably in the form of an LED-type luminous strip. It is however also conceivable for the further indication element to be of some other configuration that appears expedient to a person skilled in the art. By means of the embodiment according to the disclosure, it can advantageously be made possible for further characteristic variables of the handheld power tool to additionally be indicated. Furthermore, the further indication element can advantageously be used as an operator guide, in order to achieve that the handheld power tool can be operated in a self-explanatory manner.

It is furthermore proposed that the indication unit have at least one electrical and/or electronic graphic indication element which is at least partially circumferentially arranged on the housing unit. Here, a "graphic indication element" should be understood in particular to mean an element by means of which alphabetic characters, diagrams, symbols, pictograms, images, films etc. can be visually depicted. Here, the graphic indication element may be formed as a line display, as an LCD, as an AMOLED, as an LED display, as a multi-line display, as at least five interconnected LED-type luminous strips etc. By means of the embodiment according to the disclosure, a handheld power tool characteristic variable can be indicated to an operator in a particularly advantageous manner. It is thus advantageously possible for information to be output to an operator in a clear, understandable and unambiguously attributable manner. It is thus furthermore also possible for complex information to be output.

Furthermore, in at least one embodiment of the handheld power tool according to the disclosure, it is proposed that the indication element at least partially form the graphic indication element. The indication element preferably forms at least one line of the graphic indication element. For this purpose, the indication element is preferably in the form of an LED-type luminous strip. In this case, each LED of the LED-type luminous strip is individually controllable. It is however also conceivable for the indication element for at least partially forming the graphic indication element to be of some other configuration that appears expedient to a person skilled in the art. By means of the embodiment according to the disclosure, it is possible in a structurally simple manner to realize a graphic indication element for indicating alphabetic characters, diagrams, symbols, pictograms, images, films etc.

It is furthermore proposed that the indication unit have at least one electrical and/or electronic graphic indication element which is arranged at least substantially adjacent to the indication element. The graphic indication element is preferably in the form of a multi-line display, and the indication element is preferably in the form of an LED-type luminous strip or some other light source element which appears expedient to a person skilled in the art and which has individually controllable light sources. An operator can advantageously be notified, by means of the indication element, of information depicted by means of the graphic indication element. Thus, advantageous outputting of information to an operator can be made possible, which permits handling of the handheld power tool in an optimum performance spectrum.

It is furthermore proposed that the graphic indication element be of touch-sensitive design. The graphic indication element is particularly preferably in the form of a touch-sensitive display. It is however also conceivable for the touch-sensitive graphic indication element to be of some other configuration that appears expedient to a person skilled in the art. By means of the embodiment according to the disclosure, it is advantageously possible for an operator to react to information indicated by means of the graphic indication element by actuating the touch-sensitive graphic indication element. Convenient operation of the handheld power tool can thus be advantageously achieved.

It is furthermore proposed that the indication unit have at least one projection unit which is provided for projecting at least one handheld power tool characteristic variable onto a machining tool arranged on the tool receptacle. It is advantageously possible for information to be output to an operator in a direct working area of the handheld power tool. Furthermore, by means of the projection unit, it is advantageously possible for machining tool wear to be depicted in that, for example, there can be projected onto the machining tool a colored marking which changes during the machining of a workpiece, in particular as a result of a decrease of a diameter of a machining tool of disk-shaped form.

Here, it is not the intention for the handheld power tool according to the disclosure to be restricted to the usage and embodiment described above. In particular, to perform a function described herein, the handheld power tool according to the disclosure may have a number of individual elements, components, units and/or method steps that differs from the number stated herein.

BRIEF DESCRIPTION OF THE DRAWINGS

Further advantages will emerge from the following description of the drawings. The drawings illustrate exemplary embodiments of the disclosure. The drawings, the description, and the claims contain numerous features in combination. A person skilled in the art will expediently also consider the features individually and combine them to form further meaningful combinations.

In the drawings:

FIG. 2 is a schematic illustration of an alternative embodiment of a handheld power tool according to the disclosure, FIG. 3 is a schematic illustration of a detail view of an operating unit and an indication unit of the handheld power tool from FIG. 2, FIG. 3*a* is a cross-sectional schematic illustration of the indication unit of the handheld power tool from FIG. 3 along line III-a showing only the housing and the electronic indication unit.

DETAILED DESCRIPTION

Figure 1:
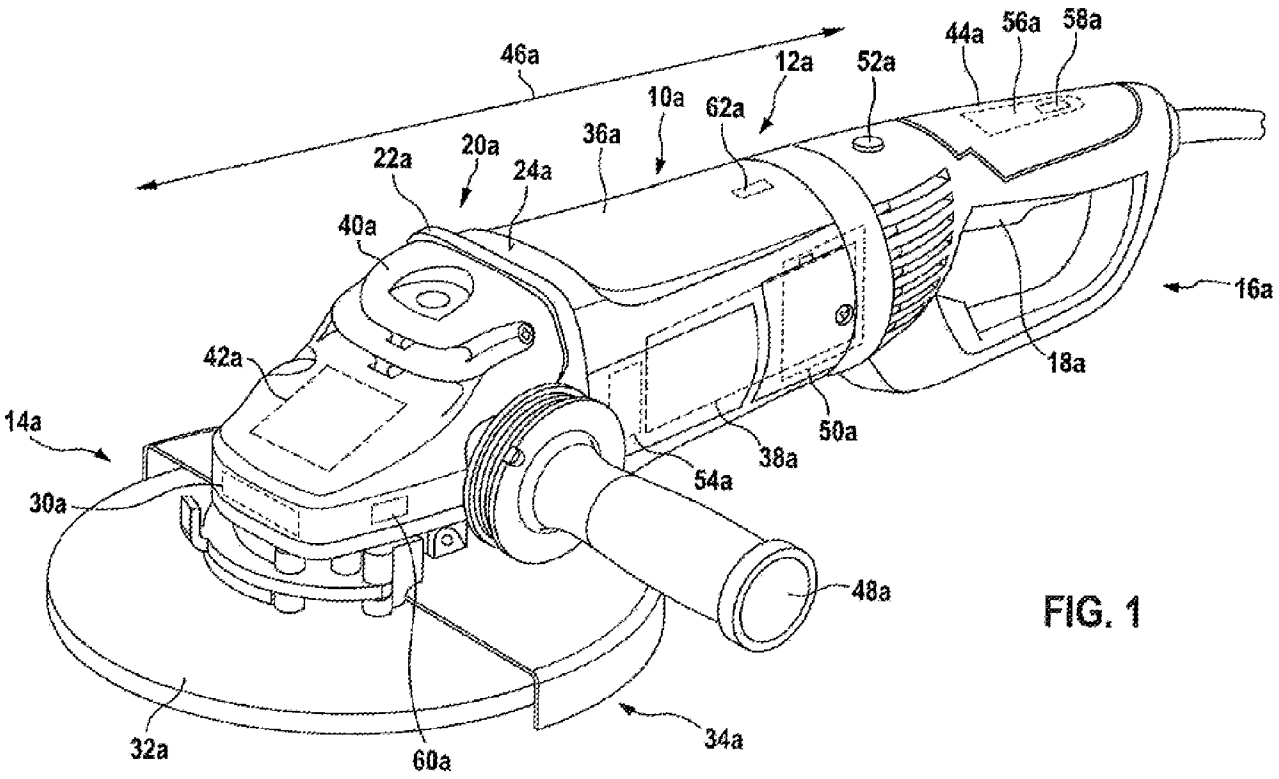
FIG. 1 is a schematic illustration of a handheld power tool according to the disclosure, which is in the form of an angle grinder.

FIG. 1 shows a handheld power tool 10*a* which is in the form of an angle grinder. Here, the handheld power tool 10*a* comprises at least one housing unit 12*a*, at least one tool receptacle 14*a*, at least one operating unit 16*a* which has at least one operating element 18*a*, and at least one electrical and/or electronic indication unit 20*a* which has at least one at least partially circumferentially arranged indication element 22*a* for indicating at least one handheld power tool characteristic variable. The housing unit 12*a* comprises at least one motor housing 36*a* for accommodating a drive unit 38*a* of the handheld power tool 10*a*. The drive unit 38*a* is in the form of a brushless electric motor unit. Here, the drive unit 38*a* is in the form of an EC electric motor unit. Furthermore, the housing unit 12*a* comprises a gearing housing 40*a* for accommodating an output unit 42*a* of the handheld power tool 10*a*. The drive unit 38*a* is provided for driving a machining tool 32*a*, which can be arranged on the tool receptacle 14*a*, in rotation by way of the output unit 42*a*. The machining tool 32*a* is in this case in the form of a grinding disk. It is however also conceivable for the machining tool 32*a* to be in the form of a cutting or polishing disk. Furthermore, the handheld power tool 10*a* comprises at least one protective hood unit 34*a*. The protective hood unit 34*a* surrounds the machining tool 32*a*, when the machining tool 32*a* is arranged on the tool receptacle 14*a*, at least along an angle range of greater than 120°. Furthermore, the handheld power tool 10*a* comprises at least one main handle 44*a* which, on a side of the motor housing 36*a* facing away from the tool receptacle 14*a*, extends in the direction of a main extent direction 46*a* of the handheld power tool 10*a*. The operating element 18*a* is arranged on the main handle 44*a*. Here, the operating element 18*a* is provided at least for energizing the drive unit 38*a*. An auxiliary handle 48*a* can furthermore be detachably arranged on the gearing housing 40*a*. When the auxiliary handle 48*a* is arranged on the gearing housing 40*a*, the auxiliary handle 48*a* extends at least substantially perpendicular to the main extent direction 46*a* of the handheld power tool 10*a*. The main extent direction 46*a* runs at least substantially parallel to an axis of rotation of the drive unit 38*a*.

Furthermore, the handheld power tool 10*a* comprises at least one control and/or regulation unit 50*a* which is provided at least for controlling and/or regulating the drive unit 38*a*. Furthermore, the control and/or regulation unit 50*a* is provided for controlling and/or regulating the indication unit 20*a*. Here, the indication unit 20*a* can be controlled and/or regulated by means of the control and/or regulation unit 50*a* in a manner dependent on a state, and/or in a manner dependent on a set operating mode, of the handheld power tool 10*a*. Thus, at least one item of information regarding the state, for example an optimum working range, an overload, a servicing requirement etc., and/or regarding the set operating mode, for example a power-saving mode, a standby mode, characteristic variables of an operating mode (rotational speed, torque etc.) etc., can be indicated to an operator by means of the indication unit 20*a*. Here, the information can be indicated by indication of different colors and/or by way of different indication modes, for example slow blinking, fast blinking, constant illumination etc., of the indication unit 20*a*. For indicating information, the indication unit 20*a* comprises at least the indication element 22*a*. Viewed along the main extent direction 46*a*, the indication element 22*a* is arranged on the housing unit 12*a* in a region between the operating element 18*a* and the tool receptacle 14*a*. In this case, the indication element 22*a* is arranged on the housing unit 12*a* close to an output. Thus, viewed along the main extent direction 46*a*, the indication element 22*a* has a minimal spacing to an output movement axis of an output element (not illustrated in any more detail here) in the form of an output spindle of the output unit 42*a*, said spacing being less than 100 mm Viewed along the main extent direction 46*a*, the indication element 22*a* is arranged between the motor housing 36*a* and the gearing housing 40*a*. Thus, the indication element 22*a* is arranged adjacent to the motor housing 36*a* and adjacent to the gearing housing 40*a*. In this case, the indication element 22*a* may be arranged in a region of an air-guiding ring of a ventilation unit (not illustrated in any more detail here) of the handheld power tool 10*a*, or the indication element 22*a* itself forms the air-guiding ring.

The indication element 22*a* is in the form of an LED-type luminous strip which has multiple LEDs arranged along a longitudinal extent of the indication element 22*a*. In this case, the LEDs are arranged so as to be distributed uniformly along a longitudinal extent of the indication element 22*a*. It is however also conceivable for the LEDs to be arranged so as to be distributed non-uniformly along the longitudinal extent. Furthermore, the indication element 22*a* comprises at least one light conductor which at least partially covers the LEDs. The LEDs of the indication element 22*a* in the form of an LED-type luminous strip can be controlled and/or regulated individually by means of the control and/or regulation unit 50*a*. The longitudinal extent of the indication element 22*a* extends at least substantially perpendicular to the main extent direction 46*a* of the handheld power tool 10*a*. Thus, the longitudinal extent of the indication element 22*a* extends along a circumferential direction of the handheld power tool 10*a*. In this case, the longitudinal extent of the indication element 22*a* extends in a plane running at least substantially perpendicular to the main extent direction 46*a*.

Viewed along the circumferential direction of the handheld power tool 10*a*, the indication element 22*a* extends around the housing unit 12*a* over at least 25% of a maximum overall circumferential extent of the housing unit 12*a*. In this case, the indication element 22*a* preferably extends around the housing unit 12*a* at least substantially along the entire maximum overall circumferential extent of the housing unit 12*a*. Thus, the indication element 22*a* is of annular form. The indication element 22*a* terminates at least substantially flush with an outer surface 24*a* of the housing unit 12*a*. Thus, viewed along a direction running from an inner surface of the housing unit 12*a* in the direction of the outer surface 24*a* of the housing unit 12*a*, the indication element 22*a* extends at most 8 mm beyond the outer surface 24*a* of the housing unit 12*a*. In this case, viewed along a direction running from an inner surface of the housing unit 12*a* in the direction of the outer surface 24*a* of the housing unit 12*a*, the light conductor, on a side of the light conductor facing away from the LEDs, extends at most 8 mm beyond the outer surface 24*a* of the housing unit 12*a*, or at most as far as the outer surface 24*a* of the housing unit 12*a*. It is however also conceivable for the indication element 22*a* to be formed without a light conductor, and thus for the individual LEDs to extend at most 8 mm beyond the outer surface 24*a* of the housing unit 12*a*.

To indicate a direction of rotation, the indication element 22*a* can be controlled and/or regulated by means of the control and/or regulation unit 50*a* such that a revolving light signal corresponding to the direction of rotation can be generated by means of the indication element 22*a*. To indicate a rotational speed, the indication element 22*a* can, by means of the control and/or regulation unit 50*a*, be controlled and/or regulated with regard to a color and with regard to a speed of revolution in a manner dependent on a rotational speed of the drive unit 38*a*. For example, a green and slowly revolving light signal can be generated by means of the indication element 22*a* in the case of a low rotational speed. Furthermore, it is conceivable for a light intensity and/or an illuminated region of the indication element 22*a* to likewise be variable in a manner dependent on the rotational speed. Furthermore, an overload of the drive unit 38*a* can be indicated for example by illumination of the entire indication element 22*a* in one color and/or by means of a variation of a speed of revolution and/or by means of a color change. Furthermore, it is for example possible for an optimum operating point of the handheld power tool 10*a* to be indicated by means of the indication element 22*a* through an indication of a light signal. In this case, it is conceivable for the control and/or regulation unit 50*a* to vary a light intensity, a speed of revolution, a color and/or an illuminated region of the indication element 22*a* in a manner dependent on an optimum operating point of the handheld power tool 10*a* being approached. A standby mode of the handheld power tool 10*a* can be indicated for example by means of a uniform variation of a light intensity, for example by virtue of the brightness of the indication element 22*a* increasing and decreasing again. Furthermore, it is conceivable that a speed of revolution and further characteristic variables of the indication element 22*a* that would appear expedient to a person skilled in the art can be varied in order to indicate the standby mode. It is thus advantageously possible for information regarding a state and/or an operating mode of the handheld power tool 10*a* to be visually output to an operator.

Furthermore, the indication unit 20*a* comprises at least one projection unit 30*a* which is provided for projecting at least one handheld power tool characteristic variable onto the machining tool 32*a* arranged on the tool receptacle 14*a*. It is conceivable here for a rotational speed, a power level, an efficiency, a torque and/or other characteristic variables of the drive unit 38*a* and/or of the handheld power tool 10*a* to be projectable onto the machining tool 32*a* by means of the projection unit 30*a*. Furthermore, wear of the machining tool 32*a* can be indicated by means of the projection unit 30*a*. For this purpose, it is for example possible for a color scheme running from green to red to be projected onto a surface of the machining tool 32*a* by means of the projection unit 30*a*. An operator can thus advantageously identify the extent to which the machining tool 32*a* has worn, in particular the extent to which a diameter of the machining tool 32*a* has already decreased, in a manner dependent on a color of the color scheme that is presently visible on the surface of the machining tool 32*a*.

Furthermore, the operating unit 16*a* comprises at least one operating mode setting element 52*a* by means of which an operating mode can be manually set. For example, a power-saving mode of the handheld power tool 10*a* can be activated by means of the operating mode setting element 52*a*. The power-saving mode can be output to a user for example by means of green illumination of the indication element 22*a*. Thus, in the power-saving mode, operation of the handheld power tool 10*a* can be indicated to an operator by means of the indication element 22*a*. Furthermore, by means of the projection unit 30*a*, it is possible for an optimum operating range in the power-saving mode to be indicated, for example an optimum rotational speed, an optimum contact pressure, an optimum torque etc., at which maximum work progress can be achieved with low power consumption. For indication of an optimum contact pressure, the indication unit 20*a* may comprise, in addition to the indication element 22*a*, a single LED (not illustrated in any more detail here) which is provided for indicating to an operator the attainment and/or overshooting of an optimum contact pressure. For this purpose, it is for example provided that the LED is illuminated green when an optimum contact pressure is attained, is illuminated red in the event of the optimum contact pressure being overshot, and is illuminated blue in the event of the optimum contact pressure being undershot. An operator is thus advantageously provided with feedback with regard to his or her working technique. The projection unit 30*a* may furthermore be activatable manually by an operator. It is however also conceivable for the projection unit 30*a* to be automatically activatable in a manner dependent on at least one handheld power tool characteristic variable.

The handheld power tool 10*a* furthermore comprises at least one drive unit sensor unit 54*a* for the detection of at least one drive unit characteristic variable. The drive unit characteristic variable is in this case in the form of a drive unit current, a drive unit voltage, a drive unit power or the like. The drive unit characteristic variable can be evaluated by means of the control and/or regulation unit 50*a* for an automatic activation of the power-saving mode. Here, a drive unit characteristic variable, in particular a drive unit power or a drive unit current, is detected by means of the drive unit sensor unit 54*a* over a predefined time period. The control and/or regulation unit 50*a* averages the detected values over the time period in order to calculate a mean value. The control and/or regulation unit 50*a* activates the power-saving mode in a manner dependent on the average value that is calculated. Here, the control and/or regulation unit 50*a* evaluates whether an operator demands a high level of power of the drive unit 38*a* or whether the handheld power tool 10*a* is being operated in a value range which corresponds to the power-saving mode. If operation in a value range of the power-saving mode is detected, the power-saving mode can be automatically activated by the control and/or regulation unit 50*a*. Here, it is also conceivable that the drive unit sensor unit 54*a* detects a drive unit characteristic variable throughout the operation of the handheld power tool 10*a*, and that the drive unit characteristic variable detected by means of the drive unit sensor unit 54*a* is processed by the control and/or regulation unit 50*a* throughout operation. Here, the control and/or regulation unit 50*a* activates an operating mode of the handheld power tool 10*a* in a manner dependent on the detected drive unit characteristic variable. If the control and/or regulation unit 50*a* detects for example operation of the drive unit 38*a* with a demand for high power over a long period of time, the control and/or regulation unit 50*a* automatically activates a corresponding operating mode which differs from the power-saving mode.

In the power-saving mode, the power of the drive unit 38*a* is restricted to a limit value. In this way, it is advantageously the case that, in the power-saving mode, cooling of the drive unit 38*a* is possible by convection alone, in order, for example, to advantageously reduce power consumption of a fan unit. In this way, it is advantageously possible for an efficiency of the handheld power tool 10*a* at maximum possible load to be increased. It is particularly advantageous for the power to be limited to a value between 75% and 110% of a rated power of the drive unit 38*a*, in particular to a value between 90% and 100% of the rated power of the drive unit 38*a*. An interruption in machining of a workpiece, and/or a removal from a workpiece, are preferably disregarded in terms of an automatic activation of operating modes of the handheld power tool 10*a*. It is advantageously possible for inadvertent switching into a low-power operating mode to be prevented. In the case of automatic operating mode activation by means of the control and/or regulation unit 50*a*, it is expedient, in particular if drive unit characteristic variables are detected throughout operation, not to restrict a drive unit power output, in order that disadvantageous determination of step changes in load is advantageously avoided.

Alternatively or in addition to the drive unit sensor unit 54*a*, the handheld power tool 10*a* comprises at least one operator sensor unit 56*a* for detecting at least one operator-specific characteristic variable. The operator-specific characteristic variable can be evaluated by means of the control and/or regulation unit 50*a* for the purpose of automatic activation of the power-saving mode. Here, the operator-specific characteristic variable may be in the form of an operator-exerted pressing force, an operator-exerted advancing force, an operator-exerted holding force, an operator-specific load type, an operator usage situation, an operator-exerted contact pressure, a position of at least one hand of the operator etc., or in the form of some other operator-specific characteristic variable that appears expedient to a person skilled in the art. The operator-specific characteristic variable is preferably in the form of an operator-exerted contact pressure. For a detection of the operator-specific characteristic variable, the operator sensor unit 56*a* comprises at least one operator sensor element 58*a*. The operator sensor element 58*a* is arranged on the main handle 44*a*. In this case, the operator sensor element 58*a* is in the form of a pressure detection foil. Here, the operator sensor element 58*a* may also be arranged at a connecting point between a vibration-damped handle surface and the main handle 44*a* in order to detect bending at the connecting point, which can be utilized for determination of an operator-exerted contact pressure. In this way, an operator-exerted contact pressure can be detected by means of the operator sensor element 58*a*. Alternatively or in addition, the operator sensor unit 56*a* comprises at least one further operator sensor element 60*a* for determining an operator-exerted contact pressure. Here, the further operator sensor element 60*a* is in the form of a pressure sensor which is arranged in the region of a bearing point of the output element, in the form of an output spindle, of the output unit 42*a*. Here, the further operator sensor element 60*a* is in the form of a strain gauge which detects an elastic deformation in the region of the bearing point. From this, an operator-exerted contact pressure can be determined by means of the control and/or regulation unit 50*a*. It is however also conceivable for the further operator sensor element 60*a* to be in the form of a rolling bearing element with integrated force detection sensor means.

The control and/or regulation unit 50*a* is provided for detecting an operator-exerted contact pressure throughout the operation of the handheld power tool 10*a* and for averaging measurement values obtained therefrom over a time period of a maximum of 5 seconds. From this, it is possible to evaluate whether an operator demands a high level of power during the machining of a workpiece or whether energy-efficient machining is preferable. Owing to an operator-exerted contact pressure being detected as an input variable, a maximum power in the power-saving mode can be determined because, here, a control variable is not equal to an input variable. To take into consideration a friction coefficient and other specific variables of the machining tool 32*a*, it is advantageous if the operator-exerted contact pressure is set in a ratio with respect to a power output of the handheld power tool 10*a* for a time period of a few seconds after commencement of machining of a workpiece. For example, a low friction coefficient leads to a low power output with a high operator-exerted contact pressure. Furthermore, a measurement of the ratio and/or of the operator-exerted contact pressure at intervals during operation may advantageously be taken into consideration for the purpose of determining the wear of the machining tool 32*a*. A factor of the ratio between the operator-exerted contact pressure and a power level can advantageously be taken into consideration for automatic operating mode selection by means of the control and/or regulation unit 50*a*.

For an increase in efficiency, in the power-saving mode of the handheld power tool 10*a*, an idle rotational speed of the drive unit 38*a* can be limited by means of the control and/or regulation unit 50*a*. In this case, the idle rotational speed can be limited to a value at which the drive unit 38*a* can be operated with optimum efficiency. An optimum rotational speed of the drive unit 38*a* is dependent on a characteristic map of the drive unit 38*a*. The optimum efficiency of the drive unit 38*a* is preferably in a rotational speed range from 55% to 75% of a maximum rotational speed of the drive unit 38*a*. Power can advantageously be saved by means of a reduced idle rotational speed. When a workpiece is machined by means of the machining tool 32*a* in a rated power range, the machining tool 32*a* reaches a rotational speed which is lower than the maximum idle rotational speed of the drive unit 38*a*. The rotational speed of the machining tool 32*a* is in this case dependent on an operator-exerted contact pressure. Thus, during the machining of a workpiece, a rotational speed can fluctuate between an idle rotational speed and a load rotational speed. An acceleration of the machining tool 32*a* to the idle rotational speed after a removal of the handheld power tool 10*a* from a workpiece requires a large amount of power, which can be saved by virtue of the idle rotational speed being limited such that the idle rotational speed is as close as possible to the optimum operating point of the handheld power tool 10*a*. As an additional function, it is conceivable for the control and/or regulation unit 50*a* to learn the operating point at which an operator is working and, on the basis thereof, an optimum idle rotational speed can be determined which yields the smallest difference in relation to an average load rotational speed. In this way, it is advantageously possible to achieve an at least substantially constant rotational speed over an entire period of machining usage. A combination of a power limitation and a rotational speed limitation in the power-saving mode advantageously permits optimized efficiency with low consumption.

Furthermore, in the power-saving mode, an air guide of the fan unit of the handheld power tool 10*a* can be optimized by means of the control and/or regulation unit 50*a* such that a low level of power can be extended for ventilation and/or cooling purposes. It is furthermore conceivable to use multiple fan units which can be controlled and/or regulated by means of the control and/or regulation unit 50*a* in a manner dependent on a cooling power demand. It is thus advantageously the case that cooling is performed in regions which have exceeded a predefined temperature threshold. For this purpose, fan units are arranged for example at power transistors, at the drive unit 38*a*, at a handle surface etc. It is however also conceivable for the handheld power tool 10*a* to comprise multiple heat pipes, multiple regulated and/or controlled flaps etc. for controlling and/or regulating a cooling power demand.

Furthermore, in the activated power-saving mode, a gearing transmission ratio of the output unit 42*a* is adaptable. By means of a variation of a gearing transmission ratio, it is advantageously possible to realize that, for a constant operator-exerted contact pressure and thus torque requirement at the output element in the form of an output spindle, the drive unit 38*a* can be operated with advantageous efficiency. To make it possible to realize a gearing transmission ratio, the output unit 42*a* may be designed for example as a belt drive with adjustable cone pulleys, as a thrust belt gear mechanism, as a cone ring transmission or the like.

Furthermore, in the power-saving mode of the handheld power tool 10*a*, a switching frequency of an inverter (not illustrated in any more detail here) of the drive unit 38*a* can be adapted by means of the control and/or regulation unit 50*a*. The inverter for activation of the drive unit 38*a* has at least one power transistor, for example a MosFET or an IGBT, which generates a pulse-width-modulated alternating current from a direct-current voltage with a high switching frequency. The pulse-width-modulated alternating current can be smoothed by inductivities of motor coils of the drive unit 38*a*. In this way, it is possible to generate a sinusoidal alternating current of variable frequency and voltage which is provided for generating a rotary field for driving the drive unit 38*a*. Common switching frequencies for the power transistor are 2 kHz, 4 kHz, 8 kHz, 16 kHz, 20 kHz and 24 kHz. The high switching frequencies of 16 kHz to 24 kHz advantageously lie outside the range of human hearing and thus advantageously generate low noise emissions. The high switching frequencies can advantageously be utilized for generating a sinusoidal frequency for the rotary field of the drive unit 38*a*. Here, a minimum switching frequency for the rotary field is proportional to a number of poles of the drive unit 38*a* and to a maximum rotational speed of the drive unit 38*a*. In the power-saving mode, the switching frequencies of the power transistor can be reduced by means of the control and/or regulation unit 50*a* to a value lower than a normal switching frequency, because at the same time, a maximum rotational speed of the drive unit 38*a* in the power-saving mode can be lowered. An efficiency of the inverter and thus of the handheld power tool 10*a* can thus advantageously be increased because the power losses of the power electronics are reduced.

The handheld power tool 10*a* furthermore comprises at least one communication unit 62*a* for a transmission of electrical and/or electronic data to and/or from an external unit (not illustrated in any more detail here). The external unit may in this case be in the form of a vacuum cleaner. The handheld power tool 10*a* can be supplied with power by means of a plug socket arranged on the vacuum cleaner. Via the communication unit 62*a*, the vacuum cleaner detects a start of operation of the handheld power tool 10*a* and is thereby likewise activated. Furthermore, by means of the communication unit 62*a*, further handheld power tool characteristic variables can be transmitted to the vacuum cleaner. Thus, the vacuum cleaner can be activated by means of the control and/or regulation unit 50*a* via the communication unit 62*a* in a manner dependent on at least one handheld power tool characteristic variable. The communication unit 62*a* is preferably in the form of a wireless communication unit. In this case, the communication unit 62*a* may be in the form of a WLAN communication unit, a Bluetooth communication unit, a radio communication unit, an RFID communication unit, an NFC unit, an infrared communication unit, a mobile radio network communication unit, a ZigBee communication unit or the like. The communication unit 62*a* is particularly preferably provided for bidirectional data transmission. In an alternative embodiment, the communication unit 62*a* is in the form of a wired communication unit, for example a LAN communication unit, a USB communication unit, a power-line technology communication unit or the like. It is however also conceivable for the vacuum cleaner to have a current sensor which is provided for detecting a current intensity of the connected handheld power tool 10*a*. Based on the detected current intensity, it is for example possible for a power level of the vacuum cleaner to be automatically adapted, or an operating mode of the vacuum cleaner is automatically selectable. A power-saving mode of the vacuum cleaner can be automatically activated in a manner dependent on a measured current intensity. In this case, the power-saving mode of the vacuum cleaner can be activated if a detected current intensity of the handheld power tool 10*a* connected to the vacuum cleaner does not change, or changes only by +/−5%, for at least 2.5 seconds. Upon activation of the power-saving mode of the vacuum cleaner, a power level can be restricted in order to save power. If a change in the current intensity by at least 15% is detected, a power level of the vacuum cleaner can be increased.

The individual states and/or operating modes of the handheld power tool 10*a* can be output to an operator by means of the indication unit 20*a*. It is thus possible for the state of the handheld power tool 10*a* to be indicated to an operator in a convenient manner. A high level of operating convenience can thus advantageously be achieved.

FIGS. 2 to 12 show further exemplary embodiments of the disclosure. The following description and the drawing are restricted substantially to the differences between the exemplary embodiments, wherein, with regard to components of identical designation, in particular with regard to components with the same reference signs, reference can basically also be made to the drawing and/or the description of the other exemplary embodiments, in particular FIG. 1. To distinguish between the exemplary embodiments, the alphabetic character a has been added as a suffix to the reference signs of the exemplary embodiment in FIG. 1. In the exemplary embodiments of FIGS. 2 to 12, the alphabetic character a has, in accordance with the exemplary embodiment, been replaced with an alphabetic character from the alphabetic character sequence b to k.

FIG. 2 shows an alternative embodiment of a handheld power tool 10*b*. The handheld power tool 10*b* has a design at least substantially analogous to the handheld power tool 10*a* described in the description of FIG. 1. Thus, the handheld power tool 10*b* comprises at least one housing unit 12*b*, at least one tool receptacle 14*b*, at least one operating unit 16*b* which has at least one operating element 18*b*, and at least one electrical and/or electronic indication unit 20*b* which has at least one at least partially circumferentially arranged indication element 22*b* for indicating at least one handheld power tool characteristic variable. The indication element 22*b* is arranged on the housing unit 12*b* in a region between the operating element 18*b* and the tool receptacle 14*b*. The operating element 18*b* is arranged on a motor housing 36*b* of the housing unit 12*b*. The motor housing 36*b* in this case forms a main handle 44*b* of the handheld power tool 10*b*. Furthermore, the indication element 22*b* is arranged at least substantially adjacent to the operating element 18*b*. Furthermore, the indication element 22*b* extends around the housing unit 12*b* over at least 25% of a maximum overall circumferential extent of the housing unit 12*b*. In this case, the indication element 22*b* extends at least substantially all the way around the housing unit 12*b* (FIG. 3*a*). Furthermore, the indication element 22*b* is in the form of an LED-type luminous strip which has a multiplicity of individually controllable LEDs. The LEDs are arranged so as to be distributed uniformly along a longitudinal extent of the indication element 22*b*. It is however also conceivable for the LEDs to be arranged so as to be distributed non-uniformly along the longitudinal extent. The indication element 22*b* is at least partially integrated into the operating element 18*b*.

Furthermore, the indication unit 20*b* comprises at least one electrical and/or electronic graphic indication element 28*b* (FIGS. 2 and 3) which is arranged at least partially circumferentially on the housing unit 12*b*. The electrical and/or electronic graphic indication element 28*b* is arranged at least substantially adjacent to the indication element 22*b*. Furthermore, the electrical and/or electronic graphic indication element 28*b* is at least partially integrated into the operating element 18*b* (FIG. 3). The electrical and/or electronic graphic indication element 28*b* is provided for outputting visual information to an operator in addition to the indication element 22*b*. In this case, text, diagrams, images and/or films can be output by means of the electrical and/or electronic graphic indication element 28*b*. Thus, the electrical and/or electronic graphic indication element 28*b* is in the form of a display. With regard to further features and functions of the handheld power tool 10*b*, reference can be made to the handheld power tool 10*a* described in the description of FIG. 1.

Figure 4:
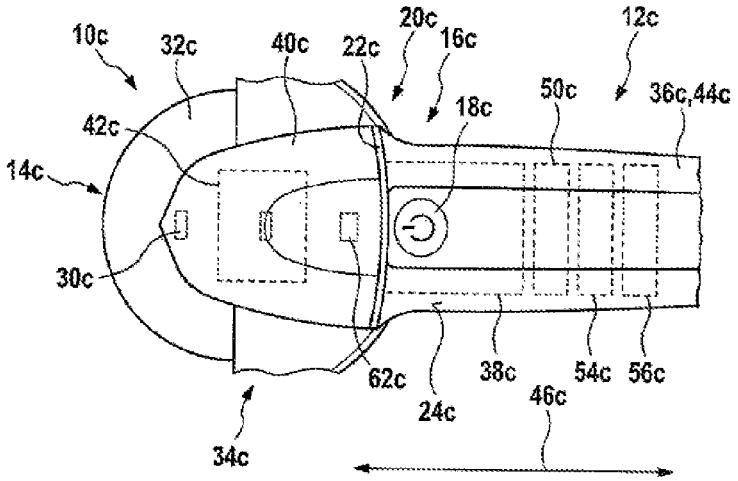
FIG. 4 is a schematic illustration of a further alternative embodiment of a handheld power tool according to the disclosure, having an operating element of an operating unit of the handheld power tool arranged adjacent to a gearing housing.

FIG. 4 shows an alternative embodiment of a handheld power tool 10*c*. The handheld power tool 10*c* has a design at least substantially analogous to the handheld power tool 10*a* described in the description of FIG. 1. Thus, the handheld power tool 10*c* comprises at least one housing unit 12*c*, at least one tool receptacle 14*c*, at least one operating unit 16*c* which has at least one operating element 18*c*, and at least one electrical and/or electronic indication unit 20*c* which has at least one at least partially circumferentially arranged indication element 22*c* for indicating at least one handheld power tool characteristic variable. The indication element 22*c* is arranged on the housing unit 12*c* in a region between the operating element 18*c* and the tool receptacle 14*c*. The operating element 18*c* is arranged on a motor housing 36*c* of the housing unit 12*c*. In this case, the operating element 18*c* is arranged at a transition between the motor housing 36*c* and a gearing housing 40*c* of the housing unit 12*c*. In this case, the motor housing 36*c* forms a main handle 44*c* of the handheld power tool 10*c*. Furthermore, the indication element 22*c* is arranged at least substantially adjacent to the operating element 18*c*. Furthermore, the indication element 22*c* extends around the housing unit 12*c* over at least 25% of a maximum overall circumferential extent of the housing unit 12*c*. In this case, the indication element 22*c* extends at least substantially all the way around the housing unit 12*c*. The indication element 22*c* is in the form of a light conductor which can be illuminated by means of at least one illumination element (not illustrated in any more detail here) of the indication unit 20*c*. It is however also conceivable for the indication element 22*c* to be in the form of an LED-type luminous strip or some other element that appears expedient to a person skilled in the art. The indication element 22*c* is formed integrally with the motor housing 36*c*. In this case, the indication element 22*c* is formed integrally with the motor housing 36*c* by means of an injection molding process, in particular by means of a two-component injection molding process. With regard to further features and functions of the handheld power tool 10*c*, reference can be made to the handheld power tool 10*a* described in the description of FIG. 1.

Figure 5:
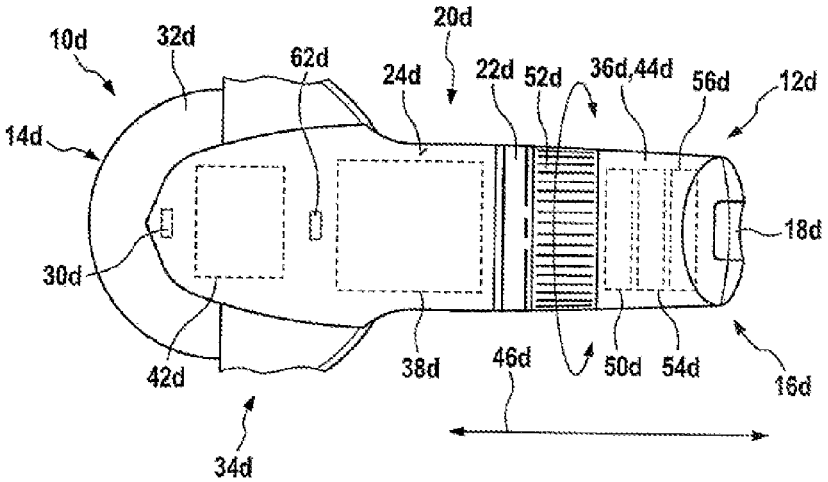
FIG. 5 is a schematic illustration of a further alternative embodiment of a handheld power tool according to the disclosure, having an operating element of an operating unit of the handheld power tool arranged on a side facing away from a gearing housing.

FIG. 5 shows an alternative embodiment of a handheld power tool 10*d*. The handheld power tool 10*d* has a design at least substantially analogous to the handheld power tool 10*a* described in the description of FIG. 1. Thus, the handheld power tool 10*d* comprises at least one housing unit 12*d*, at least one tool receptacle 14*d*, at least one operating unit 16*d* which has at least one operating element 18*d*, and at least one electrical and/or electronic indication unit 20*d* which has at least one at least partially circumferentially arranged indication element 22*d* for indicating at least one handheld power tool characteristic variable. The indication element 22*d* is arranged on the housing unit 12*d* in a region between the operating element 18*d* and the tool receptacle 14*d*. The operating element 18*d* is arranged on a motor housing 36*d* of the housing unit 12*d* on a side of the motor housing 36*d* facing away from the tool receptacle 14*d*. In this case, the motor housing 36*d* forms a main handle 44*d* of the handheld power tool 10*d*. Furthermore, the operating unit 16*d* comprises at least one further operating element 64*d*. The further operating element 64*d* is designed at least for the setting and/or selection of at least one operating mode of the handheld power tool 10*d*. For this purpose, the further operating element 64*d* is mounted so as to be rotatable. In this case, an axis of rotation of the further operating element 64*d* runs at least substantially parallel to an axis of rotation of a drive unit 38*d* of the handheld power tool 10*d*. The further operating element 64*d* is mounted so as to be rotatable about the axis of rotation, counter to a spring force of a spring element (not illustrated in any more detail here) of the operating unit 16*d*, through an angle range of less than 360°. The indication element 22*d* is arranged at least substantially adjacent to the further operating element 64*d*. Furthermore, the indication element 22*d* extends around the housing unit 12*d* over at least 25% of a maximum overall circumferential extent of the housing unit 12*d*. In this case, the indication element 22*d* extends at least substantially all the way around the housing unit 12*d*. By means of the indication element 22*d*, it is possible to output to an operator which operating mode is set. With regard to further features and functions of the handheld power tool 10*d*, reference can be made to the handheld power tool 10*a* described in the description of FIG. 1.

Figure 6:
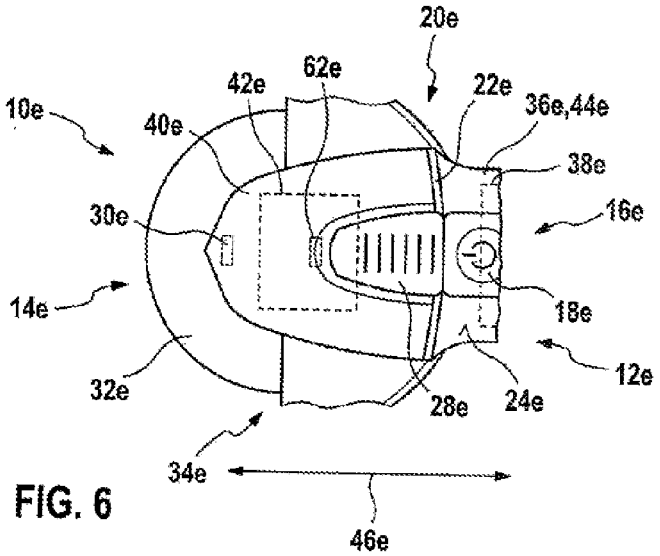
FIG. 6 is a schematic illustration of a further alternative embodiment of a handheld power tool according to the disclosure, having an operating element of an operating unit of the handheld power tool arranged adjacent to a gearing housing, and having an indication element of an indication unit of the handheld power tool arranged adjacent to said operating element.

FIG. 6 shows an alternative embodiment of a handheld power tool 10*e*. The handheld power tool 10*e* has a design at least substantially analogous to the handheld power tool 10*a* described in the description of FIG. 1. Thus, the handheld power tool 10*e* comprises at least one housing unit 12*e*, at least one tool receptacle 14*e*, at least one operating unit 16*e* which has at least one operating element 18*e*, and at least one electrical and/or electronic indication unit 20*e* which has at least one at least partially circumferentially arranged indication element 22*e* for indicating at least one handheld power tool characteristic variable. The indication element 22*e* is arranged on the housing unit 12*e* in a region between the operating element 18*e* and the tool receptacle 14*e*. The operating element 18*e* is arranged on a motor housing 36*e* of the housing unit 12*e*. In this case, the operating element 18*e* is arranged in a transition region between the motor housing 36*e* and a gearing housing 40*e* of the housing unit 12*e*. In this case, the motor housing 36*e* forms a main handle 44*e* of the handheld power tool 10*e*. Furthermore, the indication element 22*e* is arranged at least substantially adjacent to the operating element 18*e*. Furthermore, the indication element 22*e* extends around the housing unit 12*e* over at least 25% of a maximum overall circumferential extent of the housing unit 12*e*. In this case, the indication element 22*e* extends at least substantially all the way around the housing unit 12*e*. The indication element 22*e* is in the form of a light conductor which can be illuminated by means of at least one illumination element (not illustrated in any more detail here) of the indication unit 20*e*. It is however also conceivable for the indication element 22*e* to be in the form of an LED-type luminous strip or some other element that appears expedient to a person skilled in the art. The indication element 22*e* is formed integrally with the motor housing 36*e*. In this case, the indication element 22*e* is formed integrally with the motor housing 36*e* by means of an injection molding process, in particular by means of a two-component injection molding process.

Furthermore, the indication unit 20*e* comprises at least one electrical and/or electronic graphic indication element 28*e* which is arranged at least partially circumferentially on the housing unit 12*e*. The electrical and/or electronic graphic indication element 28*e* is arranged at least substantially adjacent to the indication element 22*e*. Furthermore, the electrical and/or electronic graphic indication element 28*e* is arranged on the gearing housing 40*e*. The electrical and/or electronic graphic indication element 28*e* is provided for outputting visual information to an operator in addition to the indication element 22*e*. In this case, text, diagrams, images and/or films can be output by means of the electrical and/or electronic graphic indication element 28*e*. Thus, the electrical and/or electronic graphic indication element 28*e* is in the form of a display. With regard to further features and functions of the handheld power tool 10*e*, reference can be made to the handheld power tool 10*a* described in the description of FIG. 1.

Figure 7:
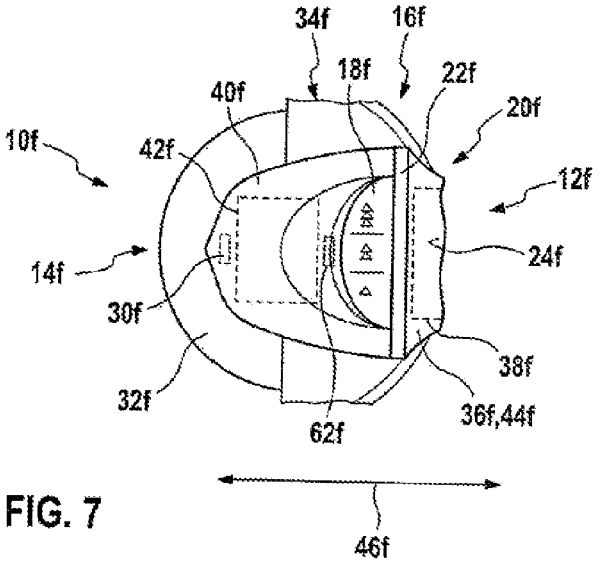
FIG. 7 is a schematic illustration of a further alternative embodiment of a handheld power tool according to the disclosure, having an operating element of an operating unit of the handheld power tool arranged on a gearing housing, and having an indication element of an indication unit of the handheld power tool arranged adjacent to said operating element.

FIG. 7 shows an alternative embodiment of a handheld power tool 10*f*. The handheld power tool 10*f* has a design at least substantially analogous to the handheld power tool 10*a* described in the description of FIG. 1. Thus, the handheld power tool 10*f* comprises at least one housing unit 12*f*, at least one tool receptacle 14*f*, at least one operating unit 16*f* which has at least one operating element 18*f*, and at least one electrical and/or electronic indication unit 20*f* which has at least one at least partially circumferentially arranged indication element 22*f* for indicating at least one handheld power tool characteristic variable. In this case, the operating element 18*f* is arranged on a gearing housing 40*f* of the housing unit 12*f*. In this case, the motor housing 36*f* forms a main handle 44*f* of the handheld power tool 10*f*. Furthermore, the indication element 22*f* is arranged at least substantially adjacent to the operating element 18*f*. In this case, the indication element 22*f* is arranged adjacent to the operating element 18*f* on a side of the operating element 18*f* facing away from the tool receptacle 14*f*. Furthermore, the indication element 22*f* extends around the housing unit 12*f* over at least 25% of a maximum overall circumferential extent of the housing unit 12*f*. In this case, the indication element 22*f* extends at least substantially all the way around the housing unit 12*f*. The indication element 22*f* is in the form of a light conductor which can be illuminated by means of at least one illumination element (not illustrated in any more detail here) of the indication unit 20*f*. It is however also conceivable for the indication element 22*f* to be in the form of an LED-type luminous strip or some other element that appears expedient to a person skilled in the art. The indication element 22*f* is formed integrally with the motor housing 36*f*. In this case, the indication element 22*f* is formed integrally with the motor housing 36*f* by means of an injection molding process, in particular by means of a two-component injection molding process. With regard to further features and functions of the handheld power tool 10*f*, reference can be made to the handheld power tool 10*a* described in the description of FIG. 1.

Figure 8:
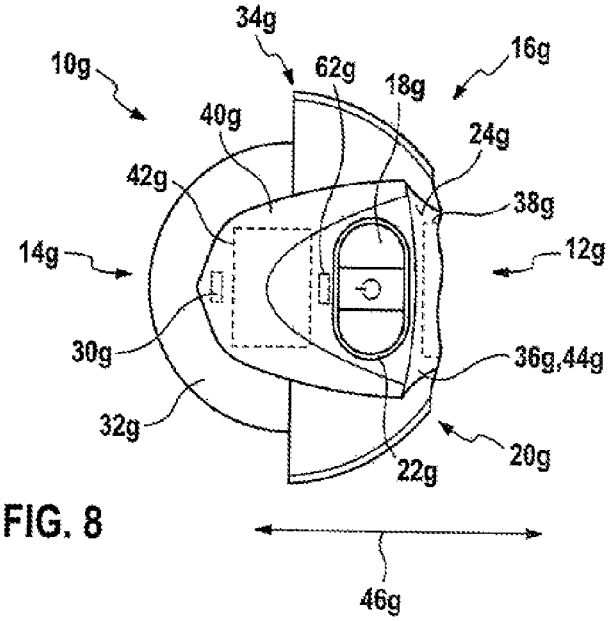
FIG. 8 is a schematic illustration of a further alternative embodiment of a handheld power tool according to the disclosure, having an operating element of an operating unit of the handheld power tool arranged on a gearing housing, and having an indication element of an indication unit of the handheld power tool arranged adjacent to said operating element.

FIG. 8 shows an alternative embodiment of a handheld power tool 10*g*. The handheld power tool 10*g* has a design at least substantially analogous to the handheld power tool 10*a* described in the description of FIG. 1. Thus, the handheld power tool 10*g* comprises at least one housing unit 12*g*, at least one tool receptacle 14*g*, at least one operating unit 16*g* which has at least one operating element 18*g*, and at least one electrical and/or electronic indication unit 20*g* which has at least one at least partially circumferentially arranged indication element 22*g* for indicating at least one handheld power tool characteristic variable. The operating element 18*g* is arranged on a gearing housing 40*g* of the housing unit 12*g*. In this case, the motor housing 36*g* forms a main handle 44*g* of the handheld power tool 10*g*. Furthermore, the indication element 22*g* is arranged at least substantially adjacent to the operating element 18*g*. In this case, the indication element 22*g* at least partially surrounds the operating element 18*g*, in particular viewed in a plane running at least substantially perpendicular to an output movement axis of an output unit 42*g* of the handheld power tool 10*g*. In this case, the indication element 22*g* extends all the way around the operating element 18. In this case, the indication element 22*g* is in the form of an LED-type luminous strip. Furthermore, the indication element 22*g* extends around the housing unit 12*g* over at least 25% of a maximum overall circumferential extent of the housing unit 12*g*. With regard to further features and functions of the handheld power tool 10*g*, reference can be made to the handheld power tool 10*a* described in the description of FIG. 1.

Figure 9:
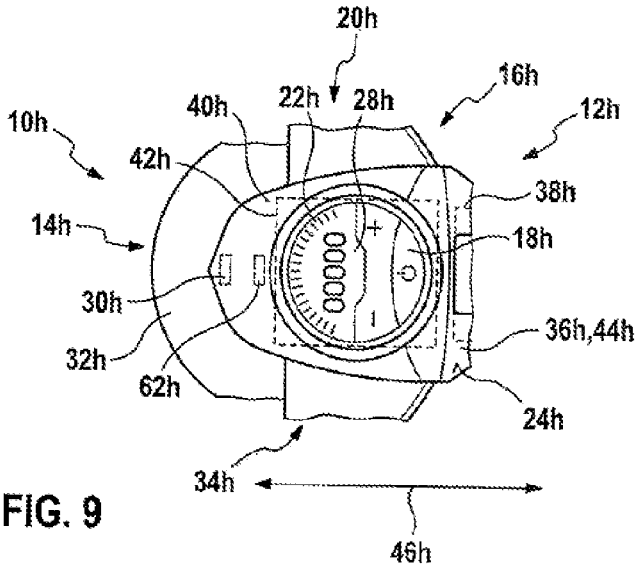
FIG. 9 is a schematic illustration of a further alternative embodiment of a handheld power tool according to the disclosure, having an operating element of an operating unit of the handheld power tool arranged on a gearing housing, and having an indication element of an indication unit of the handheld power tool, said indication element being in the form of a display.

FIG. 9 shows an alternative embodiment of a handheld power tool 10*h*. The handheld power tool 10*h* has a design at least substantially analogous to the handheld power tool 10*a* described in the description of FIG. 1. Thus, the handheld power tool 10*h* comprises at least one housing unit 12*h*, at least one tool receptacle 14*h*, at least one operating unit 16*h* which has at least one operating element 18*h*, and at least one electrical and/or electronic indication unit 20*h* which has at least one at least partially circumferentially arranged indication element 22*h* for indicating at least one handheld power tool characteristic variable. The operating element 18*h* is arranged on a gearing housing 40*h* of the housing unit 12*h*. In this case, the motor housing 36*h* forms a main handle 44*h* of the handheld power tool 10*h*. Furthermore, the indication element 22*h* is arranged at least substantially adjacent to the operating element 18*h*. Furthermore, the indication element 22*h* extends around the housing unit 12*h* over at least 25% of a maximum overall circumferential extent of the housing unit 12*h*.

Furthermore, the indication unit 20*h* comprises at least one electrical and/or electronic graphic indication element 28*h* which is arranged at least partially circumferentially on the housing unit 12*h*. The electrical and/or electronic graphic indication element 28*h* is arranged at least substantially adjacent to the indication element 22*h*. Furthermore, the electrical and/or electronic graphic indication element 28*h* is arranged on the gearing housing 40*h*. In this case, text, diagrams, images and/or films can be output by means of the electrical and/or electronic graphic indication element 28*h*. The indication element 22*h* at least partially forms the graphic indication element 28*h*. In this case, the indication element 22*h* forms at least one line of the graphic indication element 28*h*. Furthermore, the graphic indication element 28*h* is of touch-sensitive design. Thus, the graphic indication element 28*h* is formed at least partially integrally with the operating element 18*h*. Thus, the electrical and/or electronic graphic indication element 28*h* is in the form of a touch-sensitive display. With regard to further features and functions of the handheld power tool 10*h*, reference can be made to the handheld power tool 10*a* described in the description of FIG. 1.

Figure 10:
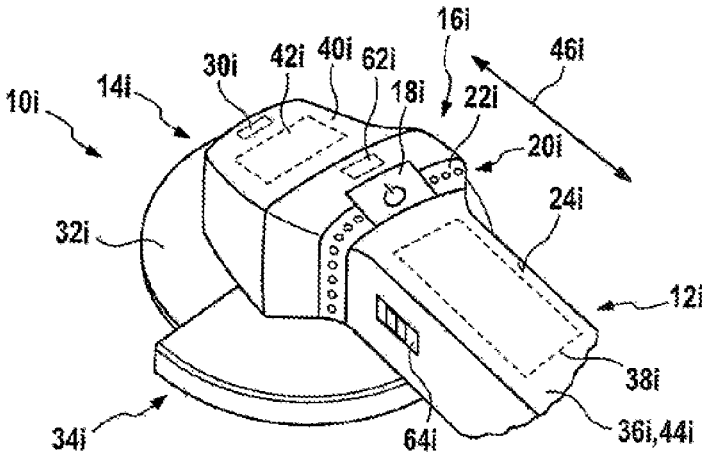
FIG. 10 is a schematic illustration of a further alternative embodiment of a handheld power tool according to the disclosure, having a circumferentially arranged indication element of an indication unit of the handheld power tool and having an operating element of an operating unit of the handheld power tool adjacent to said indication element.

FIG. 10 shows an alternative embodiment of a handheld power tool 10*i*. The handheld power tool 10*i* has a design at least substantially analogous to the handheld power tool 10*a* described in the description of FIG. 1. Thus, the handheld power tool 10*i* comprises at least one housing unit 12*i*, at least one tool receptacle 14*i*, at least one operating unit 16*i* which has at least one operating element 18*i*, and at least one electrical and/or electronic indication unit 20*i* which has at least one at least partially circumferentially arranged indication element 22*i* for indicating at least one handheld power tool characteristic variable. The operating element 18*i* is arranged on a motor housing 36*i* of the housing unit 12*i*. In this case, the motor housing 36*i* forms a main handle 44*i* of the handheld power tool 10*i*. The operating element 18*i* is arranged at least substantially adjacent to the indication element 22*i*. The indication element 22*i* extends around the housing unit 12*i* over at least 25% of a maximum overall circumferential extent of the housing unit 12*i*. In this case, the indication element 22*i* extends around the housing unit 12*i*, along a circumferential direction of the handheld power tool 10*i*, from one side of the operating element 18*i* to a further side of the operating element 18*i*.

The operating unit 16*i* furthermore comprises a further operating element 64*i* for the setting of a rotational speed of a drive unit 38*i* of the handheld power tool 10*i*. The indication element 22*i* is arranged on the housing unit 12*i* in a region between the further operating element 64*i* and the tool receptacle 14*i*. In this case, the indication element 22*i* is in the form of an LED-type luminous strip. With regard to further features and functions of the handheld power tool 10*i*, reference can be made to the handheld power tool 10*a* described in the description of FIG. 1.

Figure 11:
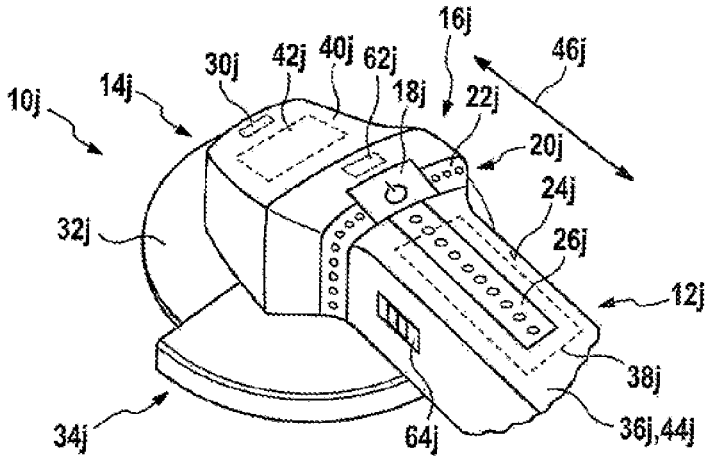
FIG. 11 is a schematic illustration of a further alternative embodiment of a handheld power tool according to the disclosure, having a circumferentially arranged indication element of an indication unit of the handheld power tool, having an operating element of an operating unit of the handheld power tool adjacent to said indication element, and having a further indication element of the indication unit.

FIG. 11 shows an alternative embodiment of a handheld power tool 10*j*. The handheld power tool 10*j* has a design at least substantially analogous to the handheld power tool 10*a* described in the description of FIG. 1. Thus, the handheld power tool 10*j* comprises at least one housing unit 12*j*, at least one tool receptacle 14*j*, at least one operating unit 16*j* which has at least one operating element 18*j*, and at least one electrical and/or electronic indication unit 20*j* which has at least one at least partially circumferentially arranged indication element 22*j* for indicating at least one handheld power tool characteristic variable. The operating element 18*j* is arranged on a motor housing 36*j* of the housing unit 12*j*. In this case, the motor housing 36*j* forms a main handle 44*j* of the handheld power tool 10*j*. The operating element 18*j* is arranged at least substantially adjacent to the indication element 22*j*. The indication element 22*j* extends around the housing unit 12*j* over at least 25% of a maximum overall circumferential extent of the housing unit 12*j*. In this case, the indication element 22*j* extends around the housing unit 12*j*, along a circumferential direction of the handheld power tool 10*j*, from one side of the operating element 18*j* to a further side of the operating element 18*j*.

Furthermore, the operating unit 16*j* comprises a further operating element 64*j* for the setting of a rotational speed of a drive unit 38*i* of the handheld power tool 10*j*. The indication element 22*j* is arranged on the housing unit 12*j* in a region between the further operating element 64*j* and the tool receptacle 14*j*. In this case, the indication element 22*j* is in the form of an LED-type luminous strip. Furthermore, the indication unit 20*j* has at least one further indication element 26*j* which has a main extent running at least substantially perpendicular to a main extent of the indication element 22*j*. In this case, a main extent of the further indication element 26*j* runs at least substantially parallel to an axis of rotation of a drive unit 38*j* of the handheld power tool 10*j*. The further indication element 26*j* is likewise arranged adjacent to the operating element 18*j*. In this case, the further indication element 26*j* is likewise in the form of an LED-type luminous strip. It is however also conceivable for the further indication element 26*j* to be of some other configuration that appears expedient to a person skilled in the art. With regard to further features and functions of the handheld power tool 10*j*, reference can be made to the handheld power tool 10*a* described in the description of FIG. 1.

Figure 12:
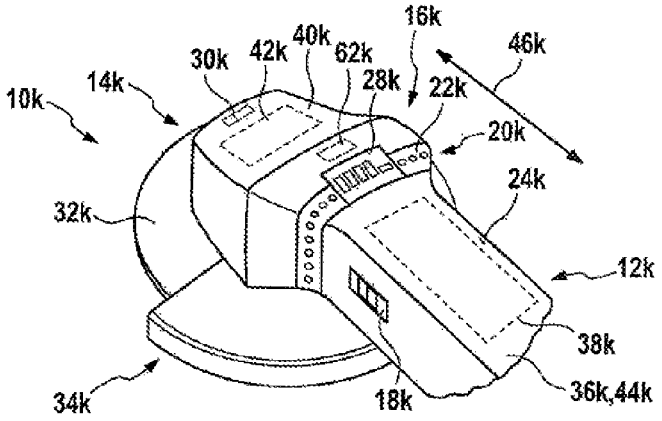
FIG. 12 is a schematic illustration of a further alternative embodiment of a handheld power tool according to the disclosure, having a circumferentially arranged indication element of an indication unit of the handheld power tool, and having a graphic indication element of the indication unit of the handheld power tool adjacent to said indication element.

FIG. 12 shows an alternative embodiment of a handheld power tool 10*k*. The handheld power tool 10*k* has a design at least substantially analogous to the handheld power tool 10*a* described in the description of FIG. 1. Thus, the handheld power tool 10*k* comprises at least one housing unit 12*k*, at least one tool receptacle 14*k*, at least one operating unit 16*k* which has at least one operating element 18*k*, and at least one electrical and/or electronic indication unit 20*k* which has at least one at least partially circumferentially arranged indication element 22*k* for indicating at least one handheld power tool characteristic variable. The operating element 18*k* is arranged on a motor housing 36*k* of the housing unit 12*k*. The indication element 22*k* is arranged on the housing unit 12*k* in a region between the operating element 18*k* and the tool receptacle 14*k*. In this case, the motor housing 36*k* forms a main handle 44*k* of the handheld power tool 10*k*. The indication element 22*k* extends around the housing unit 12*k* over at least 25% of a maximum overall circumferential extent of the housing unit 12*k*.

Furthermore, the indication unit 20*k* has at least one electrical and/or electronic graphic indication element 28*k* which is arranged at least partially circumferentially on the housing unit 12*k*. The electrical and/or electronic graphic indication element 28*k* is arranged at least substantially adjacent to the indication element 22*k*. Furthermore, the electrical and/or electronic graphic indication element 28*k* is arranged on the motor housing 36*e*. The electrical and/or electronic graphic indication element 28*k* is provided for outputting visual information to an operator in addition to the indication element 22*k*. In this case, text, diagrams, images and/or films can be output by means of the electrical and/or electronic graphic indication element 28*k*. Thus, the electrical and/or electronic graphic indication element 28*k* is in the form of a display. In this case, the indication element 22*k* extends around the housing unit 12*k*, along a circumferential direction of the handheld power tool 10*k*, from one side of the electrical and/or electronic graphic indication element 28*k* to a further side of the electrical and/or electronic graphic indication element 28*k*. In this case, the indication element 22*k* is in the form of an LED-type luminous strip. The electrical and/or electronic graphic indication element 28*k* is thus likewise arranged on the housing unit 12*k* in a region between the further operating element 64*k* and the tool receptacle 14*k*. With regard to further features and functions of the handheld power tool 10*k*, reference can be made to the handheld power tool 10*a* described in the description of FIG. 1.

What is claimed is:

1. A handheld power tool, comprising:

at least one housing unit including at least one curved surface, the at least one housing unit defining a main direction of extent of the handheld power tool;

at least one tool receptacle;

at least one operating unit having at least one operating element; and at least one electrical and/or electronic indication unit having at least one at least partially circumferentially arranged indication element arranged on the at least one curved surface and configured to indicate at least one handheld power tool characteristic variable, wherein the indication element is arranged on the housing unit in a region between the operating element and the tool receptacle along the main direction of extent, wherein the indication element extends around an entire maximum overall circumferential extent of the housing unit, and wherein the indication unit further comprises at least one projection unit that is configured to project at least one handheld power tool characteristic variable onto a machining tool arranged on the tool receptacle.

2. The handheld power tool according to claim 1, wherein the indication element is arranged on the housing unit close to an output movement axis of the at least one tool receptacle.

3. The handheld power tool according to claim 1, wherein the indication element terminates at least substantially flush with an outer surface of the housing unit.

4. The handheld power tool according to claim 1, wherein the indication unit has at least one further indication element that has a main extent running at least substantially perpendicular to a main extent of the indication element.

5. The handheld power tool according to claim 1, wherein the indication unit has at least one electrical and/or electronic graphic indication element that is at least partially circumferentially arranged on the housing unit.

6. The handheld power tool according to claim 5, wherein the indication element at least partially forms the graphic indication element.

7. The handheld power tool according to claim 1, wherein the indication unit has at least one electrical and/or electronic graphic indication element that is arranged at least substantially adjacent to the indication element.

8. The handheld power tool according to claim 5, wherein the graphic indication element is of touch-sensitive design.

9. The handheld power tool according to claim 7, wherein the graphic indication element is of touch-sensitive design.

10. The handheld power tool according to claim 1, wherein a minimum spacing between the indication element and the operating element is less than 20 mm.

11. The handheld power tool according to claim 1, wherein the indication element is configured to electrically and/or electronically indicate the at least one handheld power tool characteristic variable.

12. The handheld power tool according to claim 1, wherein the indication element includes at least one of a luminous element cover, a light conductor, a reflector, a luminous element, an individual LED, a printed circuit board with multiple LEDs, a backlit indication unit, a matrix indication unit, an LCD display, an OLED display, and electronic paper.

13. The handheld power tool according to claim 5, wherein the graphic indication element is configured to visually depict at least one of alphabetic characters, diagrams, symbols, pictograms, images, and films via at least one of a line display, an LCD, an AMOLED, an LED display, a multi-line display, and at least five interconnected LED-type luminous strips.

14. The handheld power tool according to claim 7, wherein the graphic indication element is configured to visually depict at least one of alphabetic characters, diagrams, symbols, pictograms, images, and films via at least one of a line display, an LCD, an AMOLED, an LED display, a multi-line display, and at least five interconnected LED-type luminous strips.

15. The handheld power tool according to claim 1, wherein the at least one housing unit houses a drive unit having an axis of rotation, and the main direction of extent of handheld power tool is at least substantially parallel to the axis of rotation.

16. The handheld power tool according to claim 8, wherein the graphic indication element is a touch-sensitive display.

17. The handheld power tool according to claim 1, wherein the at least one projection unit is oriented so as to emit a projection corresponding to the at least one handheld power tool characteristic variable onto the machining tool.

18. The handheld power tool according to claim 1, wherein the at least one handheld power tool characteristic variable projected onto the machining tool by the projection unit is a colored marking corresponding to a machining tool wear.

* * * * *